US007600656B2

(12) United States Patent
Karl et al.

(10) Patent No.: US 7,600,656 B2
(45) Date of Patent: Oct. 13, 2009

(54) PERSONAL HYDRATION SYSTEM

(75) Inventors: Frederick T. Karl, West Linn, OR (US); Brie G. Karl, West Linn, OR (US); William M. Dieter, Portland, OR (US)

(73) Assignee: Fiskars Brands, Inc., Madison, WI (US)

( * ) Notice: Subject to any disclaimer, the term of this patent is extended or adjusted under 35 U.S.C. 154(b) by 772 days.

(21) Appl. No.: 11/044,989

(22) Filed: Jan. 27, 2005

(65) Prior Publication Data

US 2006/0163284 A1 Jul. 27, 2006

(51) Int. Cl.
*B67D 5/64* (2006.01)

(52) U.S. Cl. ..... 222/175; 222/538; 224/148.2

(58) Field of Classification Search ..... 222/175, 222/529, 530, 490, 386, 386.5, 387, 388, 222/538; 224/148.1–148.7; 220/703
See application file for complete search history.

(56) References Cited

U.S. PATENT DOCUMENTS

| | | | | |
|---|---|---|---|---|
| D32,787 | S | 6/1900 | La Vigne | |
| 2,013,358 | A * | 9/1935 | Osborne | 224/148.2 |
| 2,760,664 | A * | 8/1956 | Amico et al. | 215/11.1 |
| 2,808,965 | A | 10/1957 | Graphia, III et al. | |
| 3,348,741 | A | 10/1967 | Wooten | |
| 4,090,650 | A | 5/1978 | Gotta | |
| 4,193,518 | A | 3/1980 | Holmes | |
| D271,803 | S | 12/1983 | Larkin et al. | |
| 4,573,631 | A | 3/1986 | Reeves | |
| 4,834,269 | A * | 5/1989 | Cone | 222/465.1 |
| 4,850,566 | A | 7/1989 | Riggert | |
| 4,852,781 | A | 8/1989 | Shurnick et al. | |
| 4,869,402 | A * | 9/1989 | Ash, Jr. | 222/209 |
| 4,948,023 | A | 8/1990 | Tripp | |
| 4,982,854 | A | 1/1991 | Ichimiya | |
| 5,005,717 | A | 4/1991 | Oilar | |

(Continued)

FOREIGN PATENT DOCUMENTS

FR 2 697 732 A1 5/1994

(Continued)

OTHER PUBLICATIONS

PCT International Search Report, based on International Application No. PCT/US2006/001278, date of mailing of the International Search Report Oct. 13, 2006 (2 pgs).

(Continued)

*Primary Examiner*—Lien T Ngo
(74) *Attorney, Agent, or Firm*—Foley & Lardner LLP

(57) ABSTRACT

A personal hydration system is configured to deliver fluid to a user. The system includes a container having a substantially fixed shape and configured to receive a quantity of a fluid. An opening is provided near a first end of the container for filling the container with the fluid. A withdrawal port is provided near a second end of the container to receive a fluid delivery tube for withdrawing fluid from the container. A channel extends at least partially along a surface of the container to retain the fluid delivery tube. A fluid lockout device has a base member coupled to either the fluid delivery tube or the withdrawal port, and a flow control member interfaces with the base member for movement between one position to permit flow and another position to prevent flow.

19 Claims, 9 Drawing Sheets

U.S. PATENT DOCUMENTS 5,060,833 A 10/1991 Edison et al.
5,085,349 A 2/1992 Fawcett
5,115,947 A 5/1992 McDonnell et al.
5,143,390 A 9/1992 Goldsmith
5,263,618 A 11/1993 Talavera
5,427,290 A 6/1995 Thatcher
5,524,612 A 6/1996 Chen
5,571,260 A 11/1996 Krug
5,597,097 A * 1/1997 Morris ..... 222/529
5,607,087 A 3/1997 Wery et al.
5,645,404 A 7/1997 Zelenak
5,722,573 A 3/1998 Carnel
5,727,714 A 3/1998 Fawcett
5,730,336 A 3/1998 Lerner
5,788,125 A * 8/1998 Steiner et al. ..... 222/331
D398,776 S 9/1998 Fawcett
5,803,333 A 9/1998 Fawcett
5,806,726 A 9/1998 Ho
D400,252 S 10/1998 Ropiak et al.
5,850,949 A * 12/1998 Koerbel et al. ..... 222/475
5,911,406 A 6/1999 Winefordner et al.
5,913,456 A 6/1999 Dikeman
D411,915 S 7/1999 George
5,971,357 A 10/1999 Denton et al.
5,975,387 A 11/1999 Gleason et al.
5,984,145 A * 11/1999 McAllister ..... 222/175
6,032,831 A 3/2000 Gardner et al.
6,039,305 A 3/2000 Hoskins et al.
6,062,435 A 5/2000 Hess, III
6,070,767 A 6/2000 Gardner et al.
6,135,329 A 10/2000 Stoneberg et al.
D436,846 S 1/2001 Millon
6,199,729 B1 3/2001 Drzymkowski
6,241,135 B1 6/2001 Thatcher
6,283,344 B1 9/2001 Bradley
6,336,566 B1 * 1/2002 Lipson ..... 215/388
6,364,168 B1 4/2002 Gardner et al.
6,409,048 B1 6/2002 Belzeski
6,494,344 B1 * 12/2002 Kressel, Sr. ..... 222/157
6,497,348 B2 12/2002 Forsman et al.
D476,079 S 6/2003 Kubalak et al.
6,666,360 B1 12/2003 Swank
6,675,998 B2 1/2004 Forsman et al.
6,971,562 B2 12/2005 Willows et al.
6,971,563 B2 12/2005 Levi
D538,030 S 3/2007 Karl et al.
D539,028 S 3/2007 Robins et al.
7,311,231 B2 * 12/2007 Noell et al. ..... 224/148.2
2002/0011583 A1 1/2002 Getzewich et al.
2002/0014498 A1 2/2002 Forsman et al.
2002/0043513 A1 4/2002 Lipson
2002/0092858 A1 7/2002 Bowman
2002/0092877 A1 7/2002 Bowman
2002/0112502 A1 8/2002 Fiore, Jr.
2002/0113101 A1 8/2002 Skillern
2002/0148806 A1 10/2002 Cheng
2002/0179647 A1 12/2002 Hall et al.
2003/0168470 A1 9/2003 Choi et al.
2003/0218035 A1 11/2003 Willows et al.
2004/0000570 A1 1/2004 Forsman
2004/0007605 A1 1/2004 Mares
2004/0045980 A1 3/2004 Robins
2005/0029313 A1 2/2005 Robins et al.
2005/0029319 A1 2/2005 Robins et al.
2005/0072804 A1 4/2005 Brown
2005/0258201 A1 * 11/2005 Willows et al. ..... 224/148.4
2006/0163284 A1 7/2006 Karl et al.
2007/0056998 A1 3/2007 Olson

FOREIGN PATENT DOCUMENTS

WO WO 2004/100708 A2 11/2004
WO WO 2006/081081 A2 8/2006
WO WO 2006/104987 A2 10/2006

OTHER PUBLICATIONS

International Search Report, based on International Application No. PCT/US2004/014179, date of mailing of the International Search Report Dec. 20, 2004 (2 pages).
Annex to Form PCT/ISA/2006, Communication Relating to the Results of the Partial International Search, based on PCT International Application No. PCT/US2006/001278 (2 pgs).
International Search Report, based on International Application No. PCT/US2008/057351, date of mailing of the International Search Report Nov. 14, 2008 (12 pgs.).
BRO Order, Boldt Products, order date Jul. 1, 2003 (1 pg.).
Lights and Hydration, Dealer Workbook, Sales Program, Boldt, Jul. 1, 2003 (4 pgs.).
Order#1, Order #2, Order #3, Boldt Products, order date Jul. 31, 2003 (3 pgs.).
U.S. Appl. No. 29/222,308, filed Jan. 27, 2005, 9 pgs.
U.S. Appl. No. 29/204,916, filed May 6, 2004, 8 pgs.
U.S. Appl. No. 10/840,751, filed May 6, 2004, 47 pgs.
U.S. Appl. No. 10/839,982, filed May 6, 2004, 41 pgs.
European Office Action for Application No. 06 718 364.0 —2313, dated May 28, 2009,4 pages.

* cited by examiner 10
70
80
42
76
44
45
96
92
160
50
130
100
32
110
90
30
56
94
24
20
22
24

FIGURE 2E
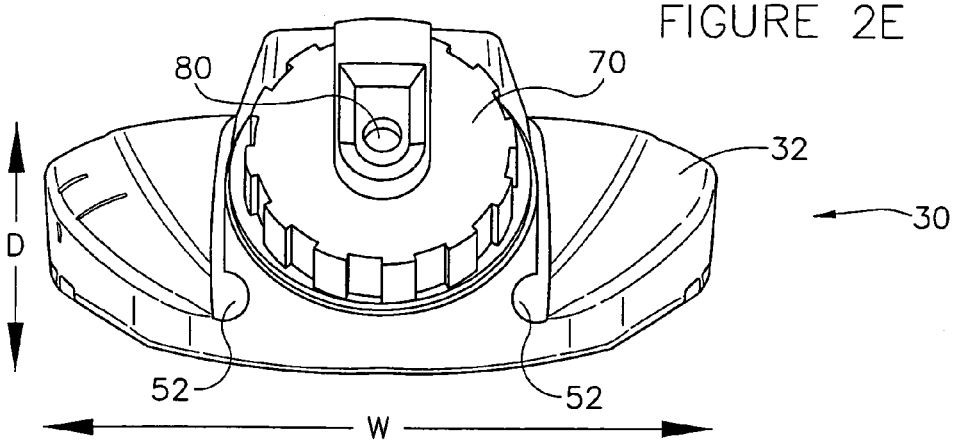
FIGURE 2F
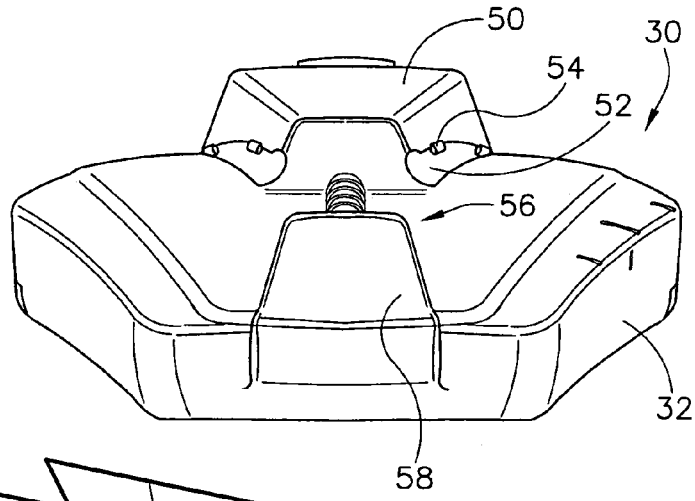
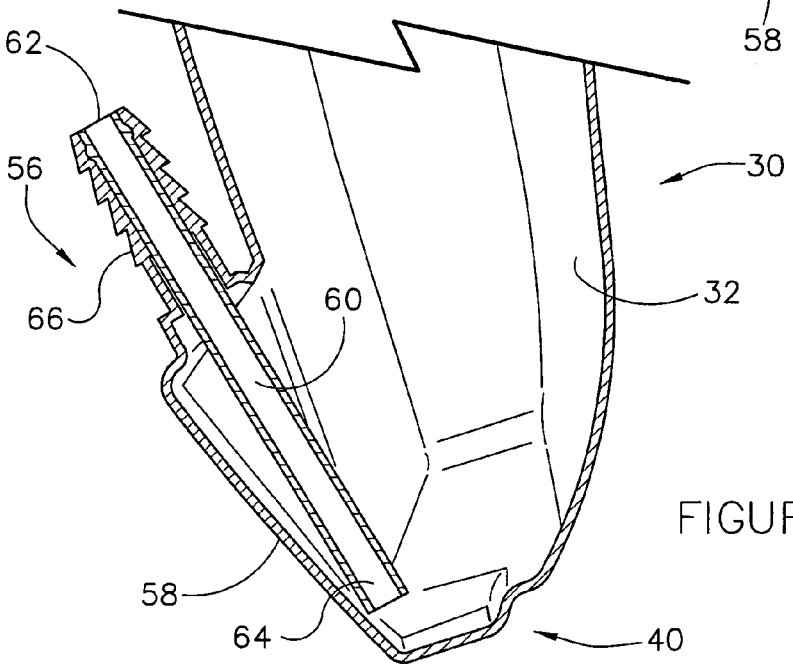
FIGURE 2G 100
110
114
112
160
130

160
164
148
146
144
140
142
124
116
162
130
100
150
133
138
132
136
114
112
110
120
124
112
110
121
118
120
122
116

PERSONAL HYDRATION SYSTEM

FIELD

The present invention relates to personal hydration systems. The present invention relates more particularly to a personal hydration system with a fluid reservoir, a vented cap and a fluid lockout valve.

BACKGROUND

The need for a ready supply of fluids to combat dehydration during strenuous activity is well known. Commonly, people who are working or recreating take periodic refreshment breaks to hydrate themselves. However, such refreshment breaks might not occur frequently enough to properly hydrate a person performing strenuous activities. Hydration systems for hydrating persons during work and/or recreation activities have grown in popularity, including participation in non-team oriented sports such as biking, hiking and running, etc. where refreshment breaks may be more difficult to accomplish.

Maintaining proper hydration levels can require the regular ingestion of fluids. Several portable devices have been developed to meet this need. Some devices include containers of rigid or of semi-rigid construction. These devices, such as aluminum canteens and plastic water bottles, are reasonably light, durable and inexpensive. However, they are often awkwardly mounted to a waist belt or in a pocket of a back pack, and thus typically require a user's hand for manipulating the container to access the liquid.

More recently, portable hydration devices have been developed that include a flexible, bag-like (e.g. soft-sided) reservoir to store fluids. This type of reservoir is often configured to be worn on a user's back with a short drinking tube and mouth piece to provide hands-free access to the fluid.

While some improvements have been made in such bag-like systems, the reservoirs of these systems are often expensive and difficult to clean due to their construction. Flexible or "soft-sided" reservoirs (e.g. bladders, bags, etc.) are typically constructed from two sheets of high grade plastic that are bonded or welded together along their edges to create a bag with water-tight seams. These bags then have components attached to them for filling and dispensing fluids, such as an input port with a large threaded neck to fill the bag which ice and water, and an output spout with a bonded or welded drink tube. The resulting reservoir is typically a water-tight, though expensive, assemblage of fused or bonded parts. These assemblages usually have many internal seams and corners that are difficult to clean with conventional methods. For example, these collapsible bags typically include small voids or traps that are difficult to clean and often require accessories for facilitating proper cleaning (e.g. a hanging rack, etc.) to permit cleaning fluid access and/or air circulation. In some cases, the difficulties associated with cleaning the bag tend to outweigh the usefulness of the hydration bag as a desirable system for providing hydration to a user.

Also, soft-sided bags usually take the form of a cylinder or conform to the shape of the container or pack when filled with a fluid. As the fluid is emptied from the bag, the bag tends to slouch or shift resulting in shifting of the weight on the user and/or distorting the shape of the pack. The soft-sided bags also tend to be cumbersome to fill with a fluid due to their lack of rigidity. In some cases, a user may freeze the filled bag to form a "cold pack" or the like, and the bag may take any of a variety of undesirable shapes when frozen, depending on the configuration of the bag during the freezing process.

Such known reservoirs also tend to have a fluid delivery passage from the reservoir leading to a tube or the like for delivering fluid from the reservoir to the user. However, such fluid delivery passage devices tend to have certain disadvantages. For example, in soft-sided bags, such known fluid passages are typically formed in a wall of a bag and tend to become blocked, kinked, or otherwise at least partially obstructed by other wall portions of the bag or the pack as the shape of the bag changes during use. In reservoirs having semi-rigid or rigid constructions, the fluid delivery passages may be integrated with a fill cap of the reservoir and sealed with o-rings or the like that tend to leak, or tend to interfere with installation or removal of the cap from the reservoir.

Such known reservoirs of hydration devices also usually include a flexible tube for delivering the fluid from the fluid delivery passage to a mouthpiece for the user. However, the tubes typically used in such devices are often unrestrained and tend to become twisted, pinched, tangled, etc. with other objects such as portions of the pack or nearby obstacles encountered by the user (e.g. tree branches, etc.). In devices where the tube is restrained, such restraints are typically in the form of separate clips (e.g. attached to the pack or the like) that may become lost, degraded, catch on external objects, etc. and result in additional cost and operations during manufacture of the hydration device.

Another feature of the known hydration devices is the mouthpiece. It is desirable that the mouthpiece acts like a valve configured to open and close at the user's command to provide access to the fluid in the reservoir. These mouthpieces often include mouth-actuated valves that are sometimes referred to as "bite valves." However, such bite valves typically have certain disadvantages. For example, conventional mouthpieces typically used with hydration devices often "leak" or otherwise undesirably dispense fluid under certain circumstances that may be encountered during normal use. For example, when pressure is applied to the reservoir (such as when the user "leans" on the reservoir, or "stacks" other objects on the pack, or vigorous or abrupt movement of the reservoir, etc.—particularly with soft-sided bags), the pressure created on the fluid may be sufficient to overcome the pressure-retaining capability of the bite valve resulting in leakage. Such leakage tends to have adverse effects such as "wetting" the pack or other moisture-sensitive articles on the user or stored in or with the pack, and reducing the available volume of fluid available for hydrating the user, etc.

Therefore, it would be desirable to provide a personal hydration system having a reservoir that is easier to clean and maintain, and that is less expensive to construct than current bag hydration system devices. It would also be desirable to provide a fluid delivery passage on the reservoir that avoids obstruction by the pack or the reservoir and that does not interfere with installation/removal of the fill cap. It would also be desirable to provide a reservoir that includes a tube retention structure for routing and retaining the fluid delivery tube. It would also be desirable to provide a lockout device for use with the fluid delivery tube to prevent leakage from the mouthpiece when fluid withdrawal by the user is not desired. It would be further desirable to provide a lockout device that is operable by a single hand of a user for enhanced convenience.

Accordingly, it would be desirable to provide a personal hydration system having any one or more of these or other advantageous features.

SUMMARY

One embodiment of the invention relates to a personal hydration system for delivering a fluid for consumption by a user. The system includes a reservoir to hold the fluid and having a rigidity for maintaining a substantially constant shape over a range of fluid levels. An angularly extending neck portion is integrally formed with a first end of the reservoir. A fluid delivery port is integrally formed with a second end of the reservoir and configured to engage a fluid delivery tube. A channel is formed in a surface of the reservoir and configured to at least partially retain the fluid delivery tube.

Another embodiment of the invention relates to a personal hydration system for delivering a stored fluid to a user. The system includes a reservoir configured to store the fluid. A fluid delivery port extends from the reservoir and is configured to receive a fluid delivery tube. A fluid shutoff device is coupled to the fluid delivery tube and is configured for operation between a closed position to prevent flow of the fluid through the tube and an open position to permit flow of the fluid. The fluid shutoff device includes a base member having a socket and a first fluid passageway, and a flow control member rotatably interfacing with the base member and having a plug and a second fluid passageway, so that the plug permits flow of fluid between the first passageway and the second passageway when the base member and the flow control member are oriented in the open position and the plug substantially prevents flow of the fluid between the first passageway and the second passageway when the base member and the flow control member are oriented in the closed position.

A further embodiment of the invention relates to a fluid delivery system. The system includes a container having a substantially fixed shape and configured to receive a quantity of a fluid. An opening is provided near a first end of the container for filling the container with the fluid. A withdrawal port is provided near a second end of the container to receive a fluid delivery tube for withdrawing fluid from the container. A channel extends at least partially along a surface of the container to retain the fluid delivery tube. A fluid lockout device has a base member coupled to either the fluid delivery tube or the withdrawal port, and a flow control member interfaces with the base member for movement between one position to permit flow and another position to prevent flow.

BRIEF DESCRIPTION OF THE DRAWINGS

FIG. 2E is a schematic representation of a top end view of a reservoir portion of the personal hydration system of FIG. 1.

FIG. 2F is a schematic representation of a bottom end view of a reservoir portion of the personal hydration system of FIG. 1.

FIG. 2G is a schematic representation of a partial cross sectional view of a bottom end of the reservoir portion of the personal hydration system of FIG. 1.

DETAILED DESCRIPTION

Referring to the FIGURES, the personal hydration system 10 is shown according to one embodiment to include (among others) a holder 20, a reservoir 30, and a fluid delivery system 90 to provide fluids to a user. The user may be a person engaged in any activity in which hydration of the user's body is desirable, such as extended periods away from conventional hydration sources, recreation, work or other strenuous activity or where the user is exposed to environments or conditions that tend to dehydrate the user. According to any preferred embodiment, the holder is shown adapted to be worn by, or otherwise attached to, a user and is configured to support the reservoir and the fluid delivery system for providing a supply of a fluid to the user. The fluid may be any fluid type suitable for hydration of a user, such as water, juice or other liquids that may contain sugars, electrolytes, etc. for hydration of the user. The reservoir is shown as configured to be secured by the holder and to store a quantity of the fluid for consumption by the user. The reservoir is formed from a material that is configured to generally retain a predetermined shape (as shown in FIGS. 2A-2G) regardless of the amount of fluid stored in the reservoir and that is readily cleanable after use. The reservoir includes a fluid withdrawal port (e.g. fluid delivery passage, etc.) having a robust construction and intended to interface with the fluid delivery system. The fluid delivery system is shown to include a tube (or tube segments) for providing a flow path from the reservoir for the fluid to be consumed by the user and includes a lockout device (e.g. valve, etc.—shown as an inline lockout device) configured for one-hand operation by a user. The lockout device includes tactile features that are intended to permit a user to operate the lockout device by "feel" (e.g. without looking at the lockout device, in the dark, etc.). The tube is configured to be at least partially retained within a retaining channel integrally formed with the reservoir.

Figure 1:
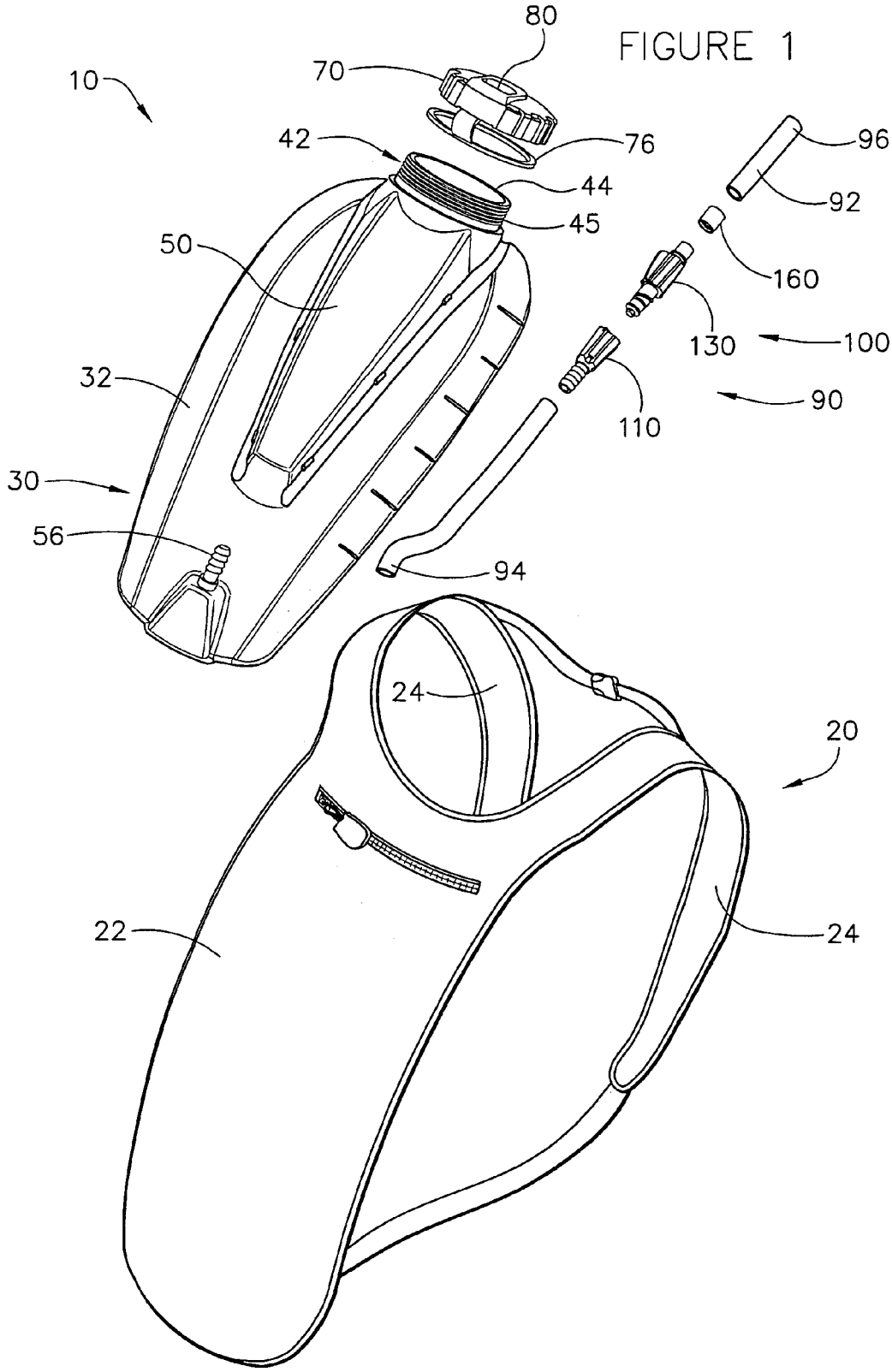
FIG. 1 is a schematic representation of an exploded perspective view of a personal hydration system according to one embodiment.
Figure 2A:
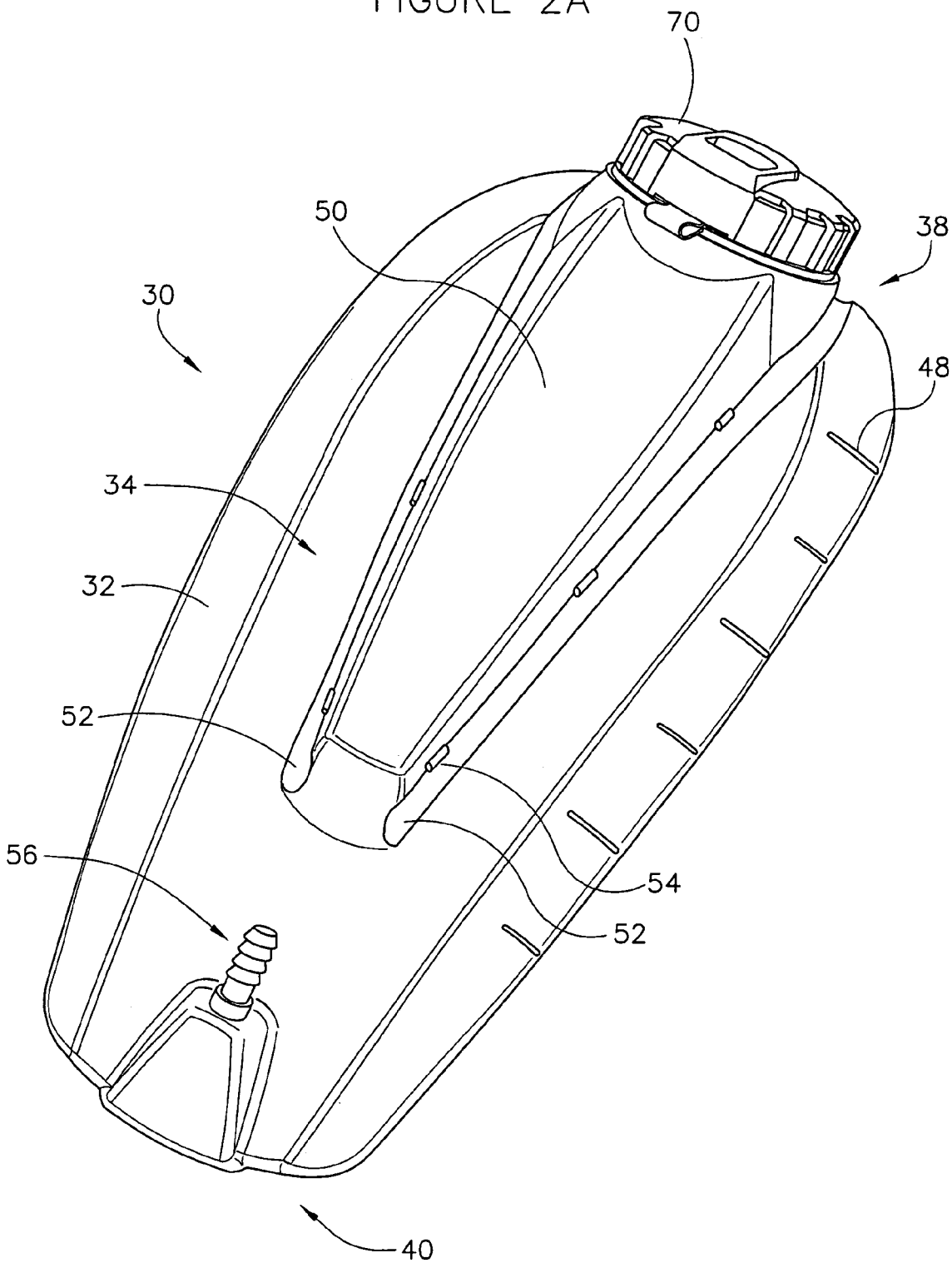
FIG. 2A is a schematic representation of a perspective view of a reservoir portion of the personal hydration system of FIG. 1.
Figure 2B:
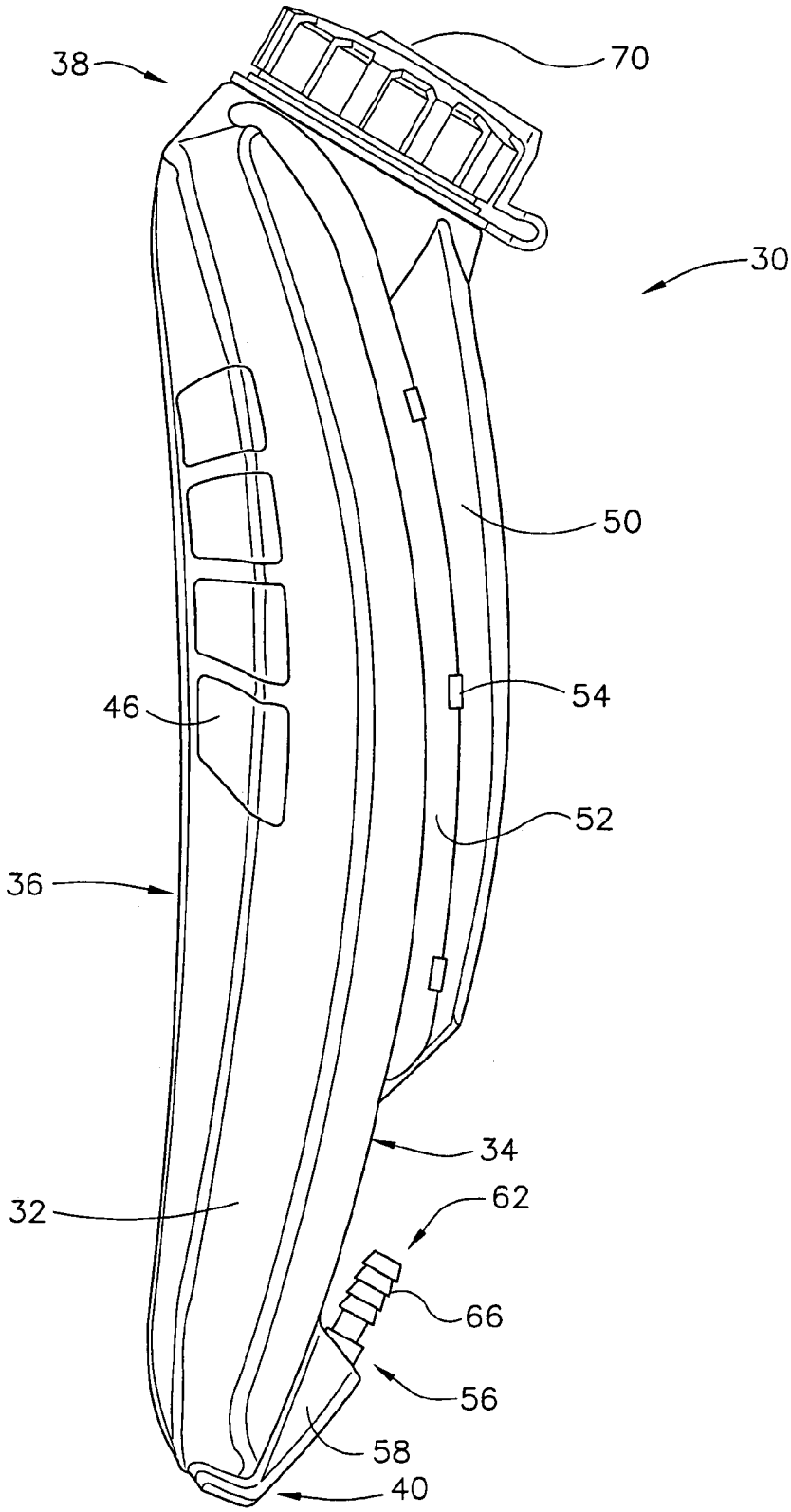
FIG. 2B is a schematic representation of a side view of a reservoir portion of the personal hydration system of FIG. 1.
Figure 2C:
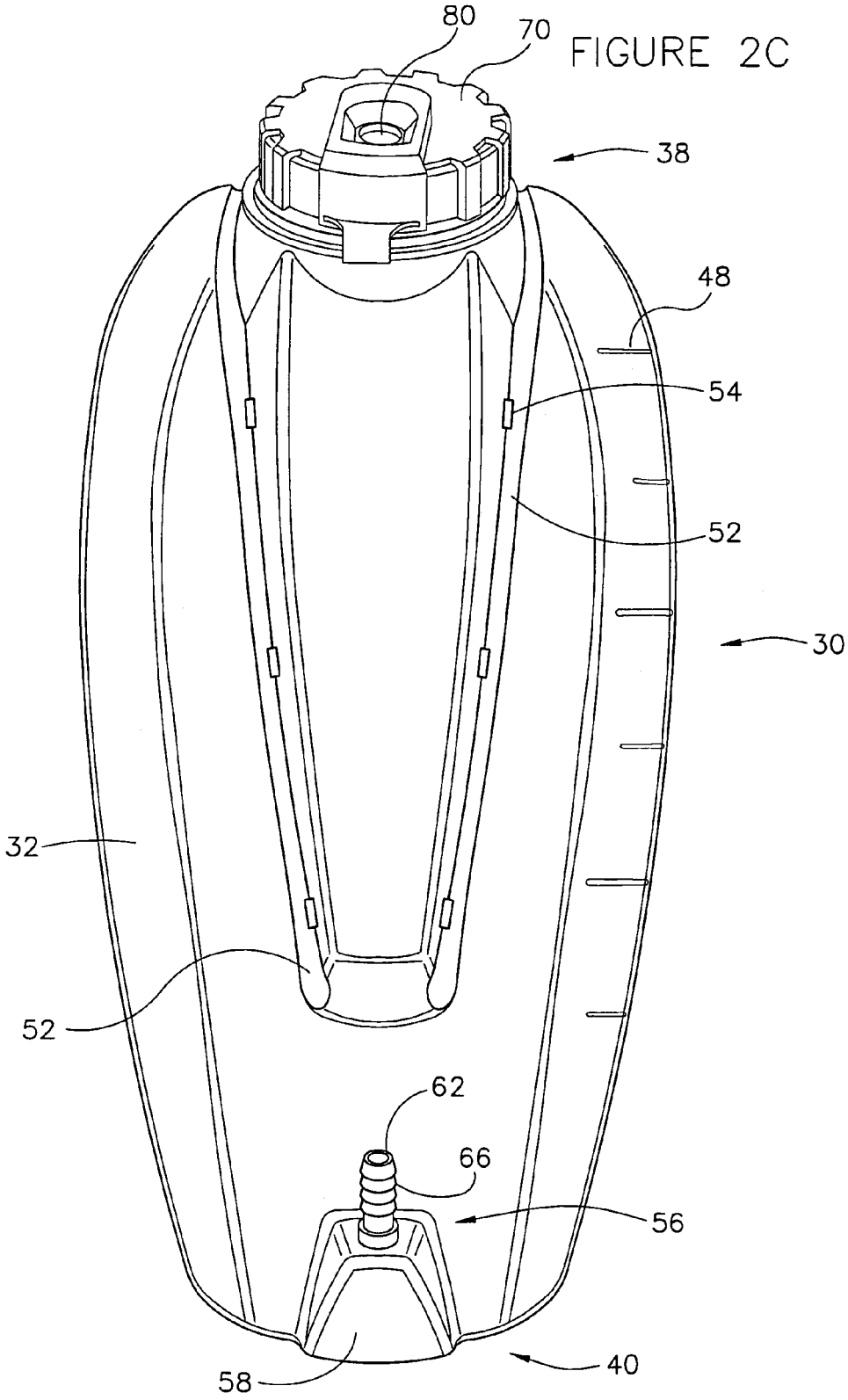
FIG. 2C is a schematic representation of a front view of a reservoir portion of the personal hydration system of FIG. 1.
Figure 2D:
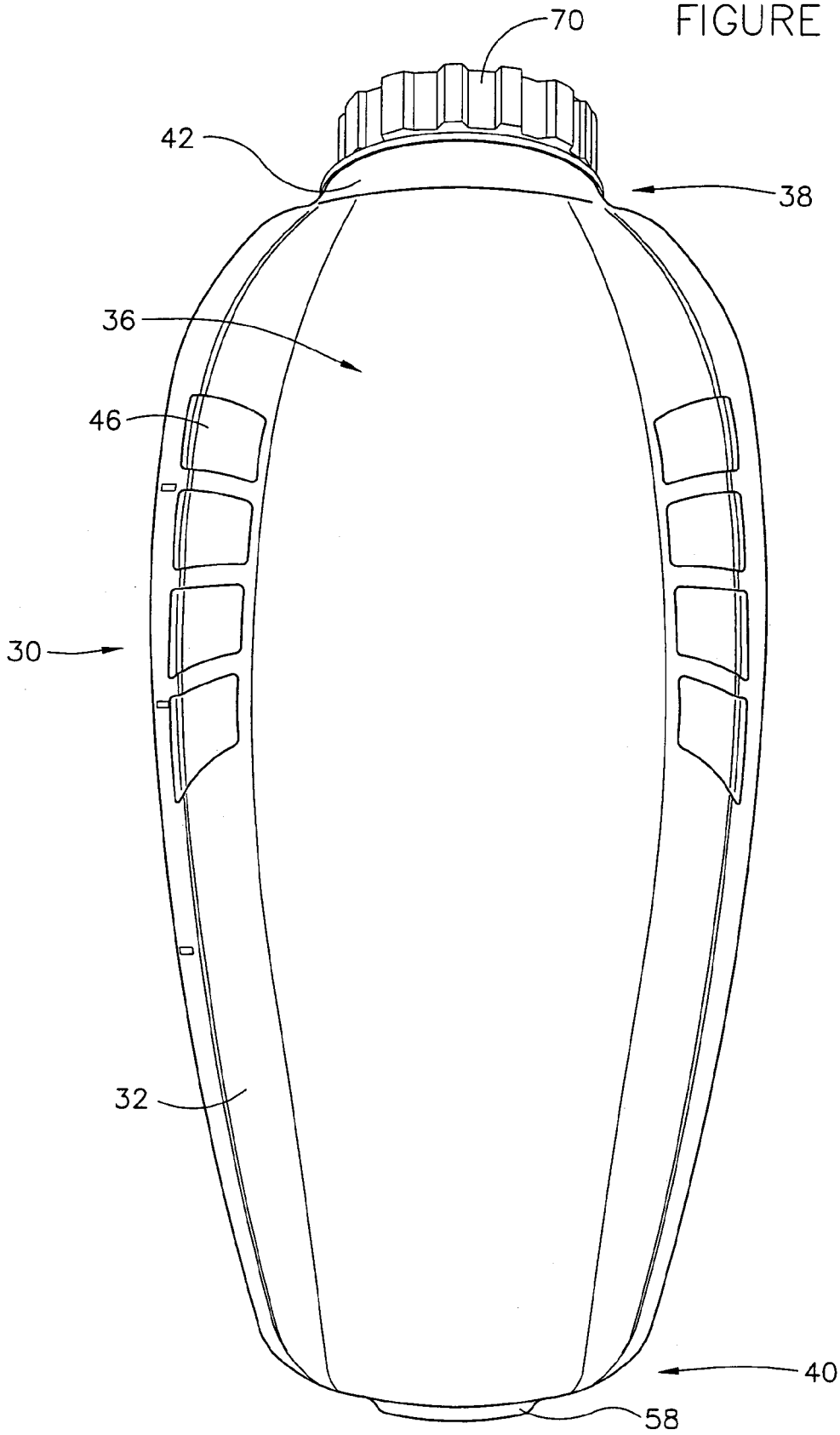
FIG. 2D is a schematic representation of a back view of a reservoir portion of the personal hydration system of FIG. 1.

Referring to FIG. 1, the holder 20 (e.g. pack, backpack, harness, carrier, sling, etc.) is shown schematically according to an exemplary embodiment. Holder 20 includes a body portion 22 shown as a sleeve having a compartment for holding the reservoir 30. The compartment has a shape generally corresponding to the shape of the reservoir so that when the reservoir acts as a "frame" for the holder to maintain a generally predetermined shape or outline when the reservoir is placed in the compartment. The holder may have additional compartments or storage devices that are intended to at least partially receive structural support from the "frame" formed by the reservoir in the compartment. The holder 20 is configured to receive the reservoir 30 in a generally "vertical" orientation with the cap 70 at the top and the fluid withdrawal port 56 at the bottom. Holder 20 further includes attachment members (shown as adjustable straps 24) extending generally from the first end to the second end of the holder, and configured to accommodate users of various sizes (e.g. "one-size fits-all") to couple the holder to the user. According to any preferred embodiment, holder 20 is made from lightweight durable materials such as Nylon, Nylon mesh, other suitable fabrics (e.g. natural or synthetic) etc. and may include padding or cushioning at suitable locations to enhance comfort to the user.

Referring to FIGS. 2A-2G, reservoir 30 (fluid container, storage device, bottle, enclosure, etc.) is shown according to an exemplary embodiment. Reservoir 30 is shown including a body 32 having a volume for containing the fluid and formed in a generally shallow arched shape having desirable aerodynamic, aesthetic and ergonomic qualities. The reservoir 30 is shown having a front surface 34, a back surface 36, a first end 38 (e.g. top) with a neck 42 for receiving a cap 70, and a second end 40 (e.g. bottom, base, etc.) with a fluid withdrawal port 56 extending in a substantially parallel orientation to the front surface 34 of the reservoir near the second end 40. According to a preferred embodiment, the reservoir is formed in a blow-molding operation from low density polyethylene (LDPE) having a width (W) to depth (D) ratio of approximately 2:1, and has an internal volume of approximately 72 fluid ounces. Formation of the reservoir with all of its structure and features in a single blow molding operation is intended to improve the manufacturability and reduce the cost of the reservoir by reducing the number of piece parts and assembly operations associated with conventional hydration systems. According to alternative embodiments, the width to depth dimensions may have any suitable ratio intended to enhance manufacturability or functionality of the reservoir, and may be made from other materials (e.g. high density polyethylene, etc.) and having any desirable volume for storing a quantity of fluid for use in hydrating a user.

According to the illustrated embodiment, body 32 of reservoir 20 is formed as a rigid or semi-rigid structural shape and is intended to be resistant to substantial deformation (e.g. "collapse," "buckle," "flatten," etc.) and retain a substantially "fixed" shape. The body is intended to have sufficient stiffness to act as a "frame" for the holder and maintain the shape of the holder when the personal hydration system is used. According to one embodiment, the holder may be provided in the form of a backpack having a compartment for holding the reservoir and also having compartment(s) or storage space for other objects (such as, but not limited to items for camping, hiking, walking, cycling, hunting, military activities, etc.) The reservoir is intended to have sufficient stiffness to serve as an internal "frame" for the backpack to maintain a desired "shape" or "form" of the backpack. Use of the reservoir as a frame within a backpack is intended to accomplish the dual purposes of providing a fluid storage receptacle and a frame, and to eliminate the need for a separate, additional frame structure within the backpack (e.g. to minimize weight, cost, permit collapse of the holder for storage or transport when the reservoir is removed, etc.). As shown in FIG. 1, the reservoir 30 is configured for loading in the holder 20 through a "top" end of the holder with the cap 70 positioned upwardly to enhance convenient refilling of the reservoir without removal of the holder or reservoir from the user (e.g. by a companion, etc.), and for self-venting of the reservoir through a vent valve in the cap. However, the reservoir may be configured in any suitable orientation within the backpack to serve as a frame and a fluid storage receptacle.

Referring further to FIGS. 2A-2F, the reservoir 30 has sufficient rigidity in a predetermined shape (e.g. firmness, stiffness, etc.) to substantially minimize deformation of body 32 when reservoir 30 is filed with fluid (e.g. chilled fluids, hot fluids, etc.) and provides substantial durability (e.g. resistance to scuffs, scrapes, punctures, ruptures, etc.) during a wide variety of potential activities by a user. Body 32 is also shown having gripping structure 46 (e.g. finger-ribs, etc.) to enhance the ability of a user to grip or grasp the body 32, such as when the body is wet or slippery, or when the reservoir would become irretrievable if dropped, etc. Body 32 is also shown to include volume indicators 48 that are intended to provide a user with a general indication of the amount of fluid remaining in the reservoir when the reservoir is oriented in a predetermined position (such as vertical). According to an alternative embodiment, the inner surface of the reservoir may be provided with one or more baffles intended to arrest or minimize motion or movement of the fluid (e.g. "sloshing" etc.) and to minimize related fluid movement noises during movement or activity by the user for applications where minimizing noise is desirable (e.g. nature watching, hunting, military activities, etc.).

Referring further to FIGS. 2A-2F, body 32 is shown to include a raised section (e.g. hump, etc.—shown as a ridge 50) along front surface 34 of the reservoir 30. Ridge 50 is intended to enhance the structural rigidity of the reservoir and to support a fill neck 42 at the first end 38. The ridge 50 also has a height profile intended to provide a certain degree of protection to the fluid withdrawal port 56 at the second end 40 of the reservoir 30. A tube retention channel 52 is shown extending along each lateral side of ridge 50 and is configured to releasably receive at least a portion of the fluid delivery tube 92 extending from the fluid withdrawal port 56. According to the illustrated embodiment, channels 52 are integrally formed with body 32 and have an arcuate profile sized to receive the fluid delivery tube in a resiliently gripping manner (e.g. by "minor" compression or deformation of the tube within either of the channels. The body 32 may also be formed with integral projections 54 (e.g. tabs, ears, etc.) to enhance retention of the tube within a channel. The channels are intended to route the tube in a predetermined and controlled manner along the reservoir to provide a compact and streamlined assembly that helps to protect the tube from twisting, kinking, or catching on foreign objects. According to an alternative embodiment, the fluid delivery tube may integrated directly with the reservoir. For example, the reservoir may be integrally formed with a fluid delivery channel (e.g. along a wall of the body, etc.) that extends from the bottom of the reservoir to a suitable location (e.g. adjacent the top of the reservoir) and having a suitable connection structure for receiving a tubing segment that extends to the user.

Referring further to FIGS. 2A-2G, the reservoir 30 includes a fluid withdrawal port 56 (e.g. fluid delivery passage, tubing connection, drain port, etc.) positioned proximate the second end 40 for receiving the tube 92 and permitting passage of fluid from the reservoir 30 to the tube 92 for consumption by the user. Fluid withdrawal port 56 is shown to include a reinforcement structure (shown as a block 58) formed with body 32 and intended to provide a durable and robust structure for a draw tube 60 extending through the reinforcement block 58. The draw tube 60 has a first end 62 projecting outwardly and upwardly from reinforcing block 58 (e.g. shown in a direction substantially parallel to front face 34 of reservoir 30 proximate the second end 40; see FIG. 2B) and having a series of retention structure (shown as barbs 66) configured to receive an end of a fluid delivery tube 92. A second end 64 of draw tube 60 is "open" (e.g. exposed, communicating, etc.) to a "low point" of the inside of the reservoir 30 so that substantially all of the fluid within the reservoir can pass through the second end 64 of the draw tube 60 when the reservoir 30 is oriented vertically (see FIG. 2G). According to a preferred embodiment, draw tube 60 is a metal tube (e.g. stainless steel, etc.) that is integrally formed with body 32 during a blow molding process. The upwardly extending orientation of the draw tube along the body of the reservoir is intended to help protect the draw tube from damage that might result from impact with other objects (such as rough handling, dropping, collision with objects during usage, etc.). According to an alternative embodiment, the exposed end of the draw tube may be provided with other structure for connection with a fluid delivery tube. For example, a quick-disconnect fitting or the like may be provided for quickly and easily disconnecting and reconnecting the fluid delivery tube or other suitable component to the draw tube.

Referring further to FIGS. 2A-2F, reservoir 30 is also shown to include an angularly extending circular portion (e.g. conduit, etc.—shown as neck 42) having an opening (e.g. mouth 44) for providing access to the internal volume of the reservoir for filling/draining hydration fluid and for cleaning (e.g. washing, drying, etc.) the inside of the reservoir. According to a preferred embodiment, neck is integrally formed with body 32 in a blow molding operation and extends at an angle of approximately thirty (30) degrees and includes external threads 45. The angular configuration and diameter of the neck 42 are intended to enhance the ability to clean the interior of the reservoir 30 by permitting direct access for cleaning (e.g. by "sprayers," "bottle-brushes" or the like, etc.) to the interior surfaces of the reservoir and to promote enhanced drainage of cleaning solutions and the like when the reservoir is inverted (e.g. neck pointed downward, such as when placed in a lower rack of a conventional dishwasher, etc.). According to an alternative embodiment, the neck may be configured with internal threads or other suitable structure for receiving a cover such as a cap.

Figure 4:
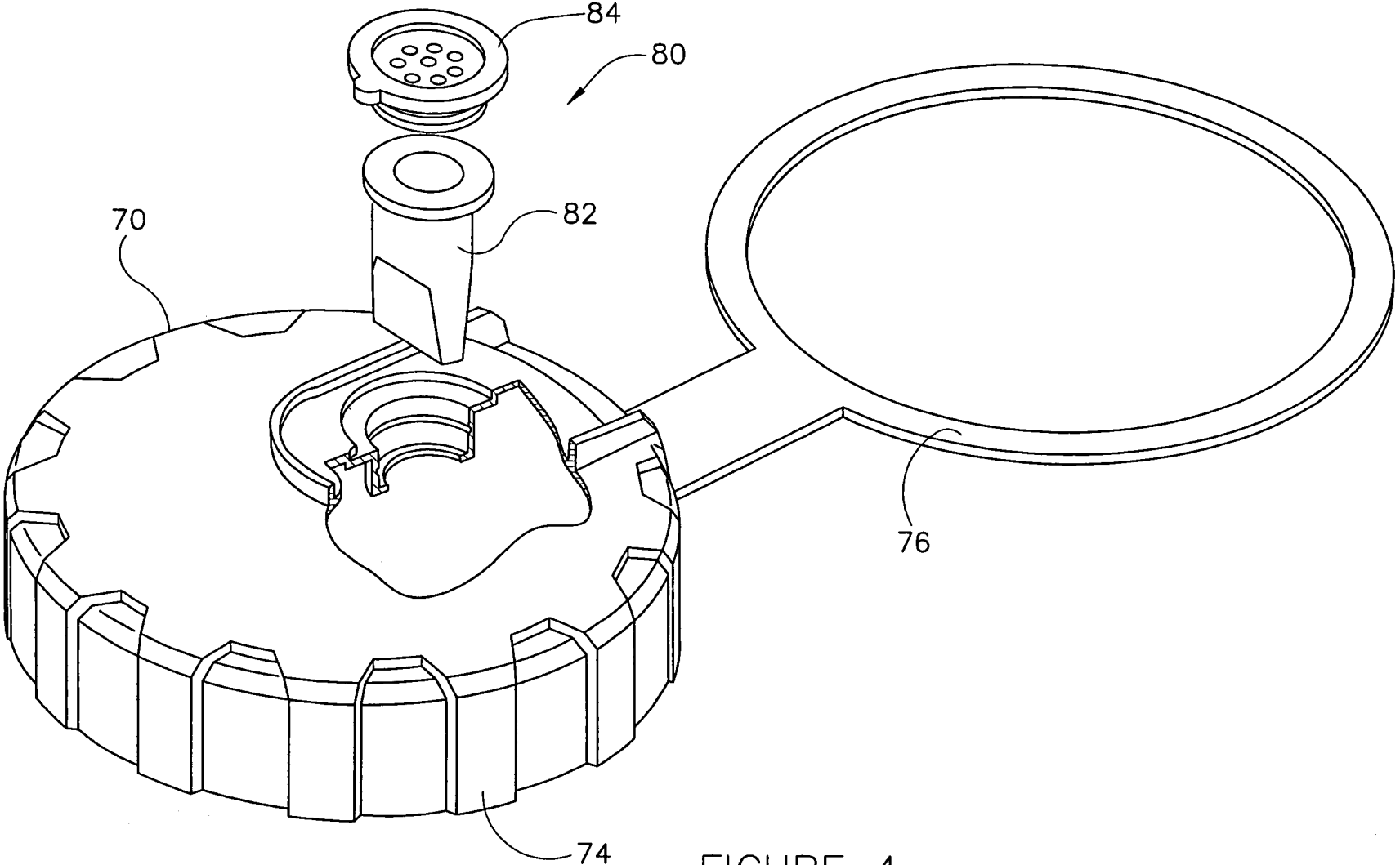
FIG. 4 is a schematic representation of an exploded perspective view of a cap of the personal hydration system of FIG. 1.

Referring further to FIGS. 1 and 4, reservoir 30 includes a removable cover (shown as a cap 70) having internal threads (not shown) configured to engage threads 45 on neck 42 for securing the cap 70 on the neck 42 for "closing" the reservoir 30. The use of a "threaded" cap is intended to minimize the number of parts that comprise the hydration system and promote a durable, robust and substantially leak-tight design that may be easily assembled by a user. Cap 70 is shown to include radially-extending projections 74 to enhance gripping and opening/closing the cap. Cap 70 is also shown to include a tether 76 secured about neck 42 for minimizing the tendency for the cap to become dropped, lost, misplaced, etc. when the cap is removed from the neck. Cap 70 further includes a venting device shown as one-way vent valve 80 located along a top panel of the cap 70 to permit air to enter the reservoir 30 as fluid is withdrawn from the reservoir by a user via the fluid withdrawal port 56. The vent valve 80 is intended to minimize formation of a vacuum within the reservoir 30 and to permit a user to withdraw fluid for hydration with relative ease. According to a preferred embodiment, vent valve 80 is a low-pressure rubber duck-bill member 82 that permits air pass into the reservoir 30 when the pressure within the reservoir decreases below the pressure of the surrounding atmosphere, yet prohibits backflow of fluid from the reservoir (e.g. when the reservoir is tipped, inverted, compressed, etc.). The vent valve 80 may be integrated into the cap in any suitable manner, such as integrally molded, press-fit, ultrasonic welding, etc. A vent cover 84 shown as a perforated panel is provided above duckbill member 82 and integrated with the top panel of the cap 70 and is intended to protect the vent valve and to minimize intrusion of foreign materials that may tend to interfere with operation of the vent valve. The cap 70 may also include a seal (e.g. rubber washer, ring, flange, etc.—not shown) along an inside surface of the top portion of the cap and configured to seal against the mouth of the neck to enhance the leak-tightness of the interface between the cap and mouth/neck. According to an alternative embodiment, the cap and neck may interact in any suitable manner to provide a durable and substantially leak-tight interface. For example, the cap may include a downwardly-extending circular wall (e.g. ring, etc.) that is configured to extend through the mouth and engage the inside wall of the neck. Also, the cap may be configured for threaded engagement with an internal surface of the neck, or an O-ring seal or the like may be provided between the neck and the circular wall of the cap. The cap may also be configured for snap-fit or compression fit with the mouth and/or neck of the reservoir.

Referring to FIGS. 1 and 3A-3F, a fluid delivery system 90 for the personal hydration system 10 is shown according to an exemplary embodiment. Fluid delivery system 90 is shown to include a fluid delivery tube 92 configured to route fluid from the reservoir to a user. Fluid delivery tube 92 has a first end 94 configured to releasably engage draw tube 60 on the fluid withdrawal port 56 of the reservoir 30. Tube 92 has a second end 96 for access by the mouth of a user for drawing fluid through the tube from the reservoir. The second end 96 of the tube may include a valve (such as a "bite valve"—not shown) intended to provide "on-demand" control of fluid flow, such as by restricting fluid flow from the tube until the valve is actuated by a user.

Referring further to FIGS. 1 and 3A-3F, the fluid delivery system 90 also includes a manually-actuatable fluid shut-off device (shown as an "inline" lockout valve 100) shown located at an intermediate location along the tube 92. Lockout valve 100 is intended to provide a device that positively shuts-off flow of fluid through the tube 92 when the hydration system is not in use and that can be easily operated by a single hand of a user to permit fluid flow in one position and to prevent fluid flow in another position. Lockout valve 100 is shown as a three-component assembly having a base member (shown as body member 110), a flow control member 130 (e.g. cap member, etc.), and a connecting member 160 (e.g. flange, etc.).

Referring to FIGS. 3A-3F, the body member 110 is shown according to an exemplary embodiment as a "stationary" component having a first end 112 with a fitting (shown as a barbed fitting 114) configured for attachment to a fluid delivery tube 92. A second end 116 of body 110 is formed as a socket 118 for receiving a first end 132 of the flow control member 130 of the lockout valve 100. The body 110 is shown as a generally "hollow" structure having an internal passageway 120 extending through the barbed fitting 114 and opening into the socket 118 for permitting through-flow of fluid (see FIG. 3C). The socket 118 has an interior surface that includes a circumferential projection (shown as a raised ring 121) intended to cooperate with the flow control member 130 to provide a tactile indication when the body 110 and flow control member 130 are oriented with respect to one another in a "full open" (e.g. "on" etc.) position to permit fluid flow (see FIG. 3E). The interior surface of the socket 118 also includes a thread 122 configured to engage a thread 133 on the flow control member 130 for "drawing" the flow control member 130 into the socket 118 of the body 110 or "retracting" or "withdrawing" the flow control member 130 from the socket 118 of the body 110 by engagement of threads 122, 133 when the flow control member is rotated. A projection 124 (e.g. "locking bump" etc.) on the second end 116 of the body 110 cooperates with a projection 146 (e.g. "locking bump" etc.) on flow control member 130 to provide a tactile indication when the body 110 and flow control member 130 are oriented with respect to one another in a "full closed" (e.g. "off" etc.) position to prevent fluid flow (see FIG. 3D).

Referring further to FIGS. 3A-3F, the flow control member 130 (e.g. cap, barrel, etc.) is shown according to an exemplary embodiment as a rotational component having a first end 132 with threads 133 configured to be rotatably received along threads 122 within the socket 118 of body 110. Flow control member 130 is a generally "hollow" structure having a fluid passageway 134 extending therethrough (see FIGS. 3D-3F). First end 132 of flow control member 130 includes a plug 136 configured to engage the opening of passageway 120 in socket 118 of body 110 in an interference-type fit when the body 110 and flow control member 130 are oriented with respect to one another in the full closed position to substantially prevent flow of fluid (see FIG. 3D). Plug 136 on flow control member 130 includes openings 138 (e.g. ports, holes, windows, vents, etc.) that communicate with passageway 134 in flow control member 130. When the flow control member 130 is rotated in a direction away from the full closed position with body 110, fluid is permitted to flow from passageway 134 and openings 138, into the socket 118 and through passageway 120 to permit fluid to be delivered to the user. Flow control member 130 also includes a circumferential recess 140 defining stops 142, 144 at opposite ends of the recess 140 that are configured to coact with the raised ring 121 in the socket 118, so that raised ring 121 contacts stop 142 when the body 110 and flow control member 130 are oriented in the full open position (see FIG. 3F) and raised ring 121 contacts stop 144 when the body 110 and flow control member 130 are oriented in the full closed position (see FIG. 3D). The raised ring 121 and the stops 142, 144 are intended to provide a tactile indication to the user when the lockout valve has reached the full open and the full closed positions. When the body 110 and flow control member 130 are in the full open position, the flow control member may be further rotated in the open direction in a manner to overcome the interference fit between raised ring 121 and stop 142 in order to remove the flow control member 130 from the body 110 (e.g. for cleaning, maintenance, etc.).

Figures 3A, 3B, 3C:
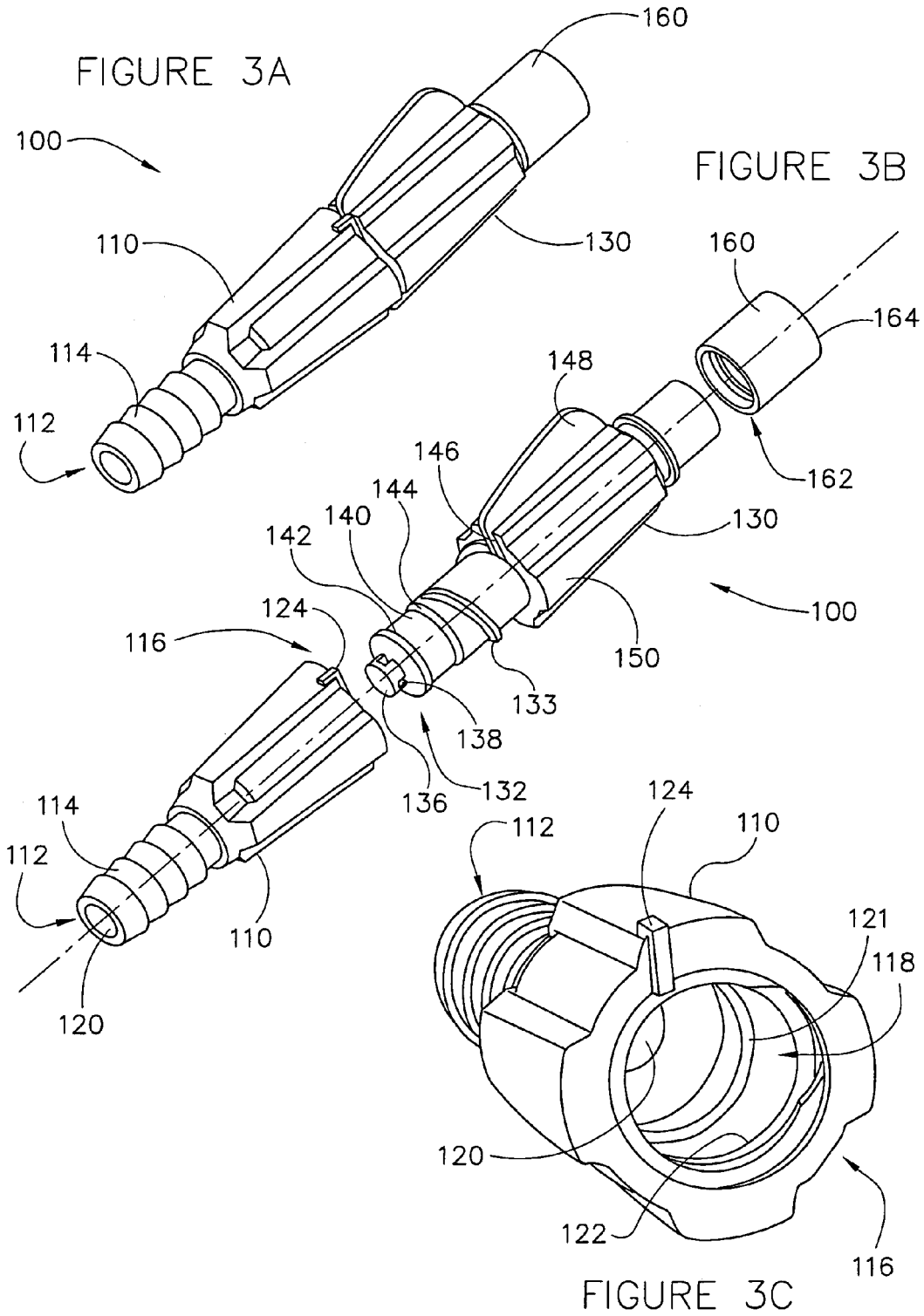
FIG. 3A is a schematic representation of a perspective view of a lockout device portion of the personal hydration system of FIG. 1.
FIG. 3B is a schematic representation of an exploded perspective view of the lockout device of FIG. 3A.
FIG. 3C is a schematic representation of a perspective view of a portion of the lockout device of FIG. 3B.
Figure 3D:
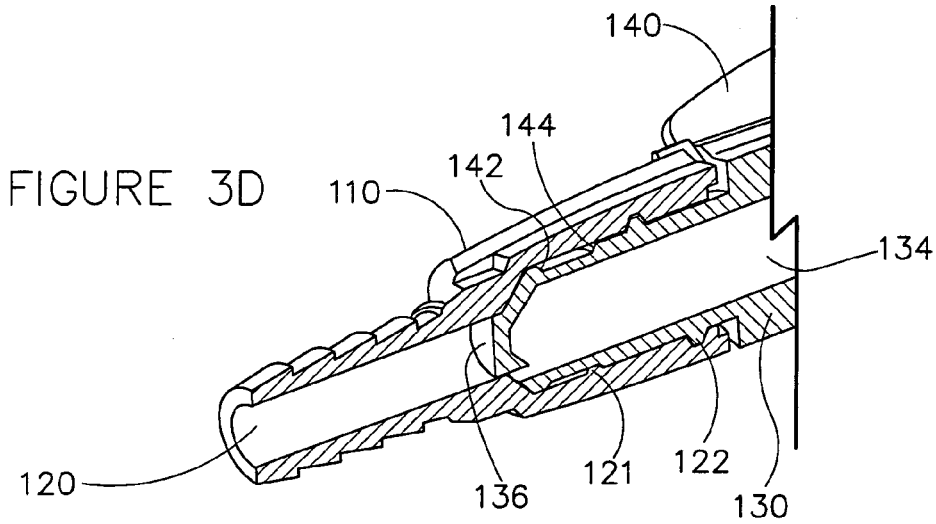
FIG. 3D is a schematic representation of a partial cross sectional perspective view of the lockout device of FIG. 3A in one position.
Figure 3E:
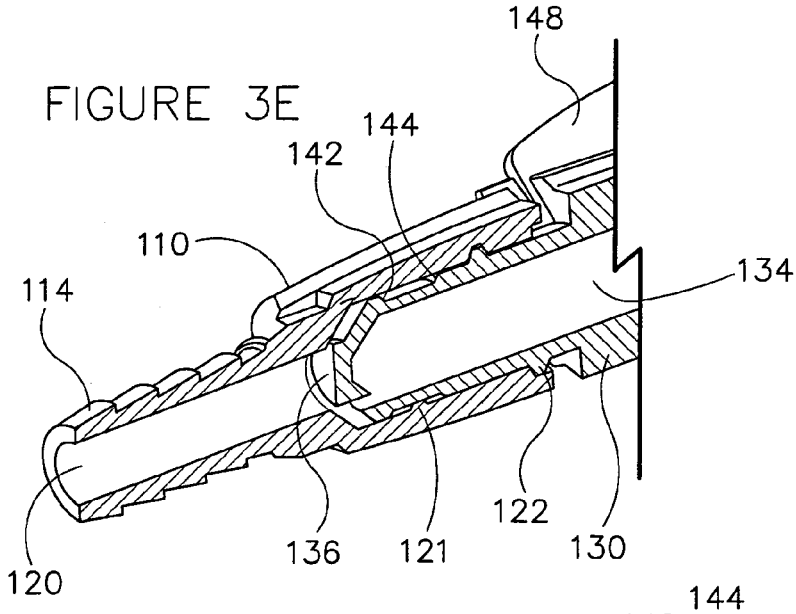
FIG. 3E is a schematic representation of a partial cross sectional perspective view of the lockout device of FIG. 3A in another position.
Figure 3F:
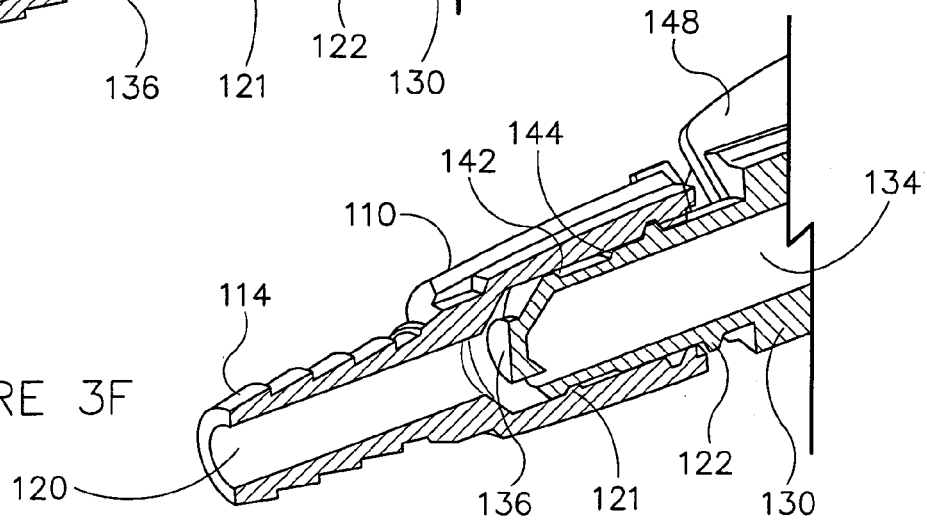
FIG. 3F is a schematic representation of a partial cross sectional perspective view of the lockout device of FIG. 3A in yet another position.

Referring further to FIGS. 3A-3F, the flow control member 130 is also shown to include a projection 146 (e.g. "locking bump" etc.) configured to engage projection 124 on body 110 in a snap-type fit when the body 110 and flow control member 130 are oriented with respect to one another in the full closed position (see FIG. 3D). Projections 124, 146 are intended to provide a tactile indication that the lockout valve is full closed and is also intended to resist unintentional opening of the lockout valve until a user opens the lockout valve by intentionally overcoming the force necessary to disengage the snap-type fit of projections 124, 146 to rotate flow control member 130 away from the full closed position. Flow control member 130 is also shown to include a tab 148 and raised surfaces 150 intended to facilitate grasping by a user to rotate the flow control member 130 (e.g. in a "one-handed" manner, etc.) between the full open and full closed positions and to provide a tactile identification of the flow control member to the user so that the flow control member may be identified and operated without visually identifying the flow control member (e.g. in the dark, while visual attention of the user is directed elsewhere, etc.). According to alternative embodiments, the arrangement and orientation of the body and flow control member may be reversed or reconfigured in any suitable manner to permit or prevent fluid flow therethrough.

Referring further to FIGS. 3A-3B, the connecting member 160 of the lockout valve 100 is shown according to an exemplary embodiment as a generally cylindrical member having a first end 162 configured to rotatably engage a second end 133 of the flow control member 130 in a rotating manner and retained on the flow control member 130 by a snap-type fit. The connecting member 160 includes a second end 164 configured to engage a segment of a fluid delivery tube (that may extend to a bite valve) or may be connected directly to a bite valve, etc. (not shown). The rotational interface between the connecting member 160 and flow control member 130 is intended to permit the flow control member to be rotated between the full open and fill closed positions without having to rotate an accessory attached to the second end of the flange (such as a bite valve that is positioned within a user's mouth, etc.). The connecting member 160 and flow control member 130 may be assembled/disassembled (e.g. for cleaning, attaching other accessories such as bite valves, etc.) by overcoming the force necessary to accomplish the snap-type fit between the components. According to alternative embodiments, the flange may include sealing components, such as a gasket or O-ring to enhance the leak-tightness of the rotating interface between the cap and flange, or between the flange and other accessories (e.g. tube segment, bite valve, etc.). According to a preferred embodiment, the body, flow control member and flange are made from a stain-resistant plastic material and formed in a molding operation. However, the components of the lockout valve may be made of any suitable material having sufficient properties to provide a durable construction for reliable operation.

According to any exemplary embodiment, the present invention provides a hydration system having various advantageous features for use in a wide variety of applications where hydration of a user is desirable such as vocational, recreational, military, healthcare, etc. The hydration system includes a lightweight, relatively rigid, durable, blow-molded reservoir having an angled neck that receives a tethered fill cap including a vent valve near a top end and an integrally formed fluid withdrawal port near a bottom end for routing fluid from the reservoir to a fluid delivery system for consumption by a user. The orientation of the neck and the shape of the reservoir are intended to define a fluid storage component that is readily and easily cleaned and that may also function as a "frame element" when used in connection with a holder such as backpack or the like. A fluid delivery system is also included providing a fluid delivery tube and a manually operable "lockout" valve device intended to provide a positive control for minimizing unintended dispensing of fluid. The lockout device includes a flow control member rotatable between an open position and a closed position and having structure that provides tactile indication to a user to permit one-handed, "no-look" operation.

It is important to note that the construction and arrangement of the elements of the personal hydration system provided herein are illustrative only. Although only a few exemplary embodiments of the present invention have been described in detail in this disclosure, those skilled in the art who review this disclosure will readily appreciate that many modifications are possible in these embodiments (such as variations in features such as components, materials, thicknesses, capacities, shapes, dimensions, proportions and configurations of the holder, reservoir, and fluid delivery system, etc. without materially departing from the novel teachings and advantages of the invention. For example, the surfaces of the reservoir may be provided in any desirable shape or contour to achieve optimum performance of the reservoir. Further, it is readily apparent that variations of the personal hydration system and its components and elements may be provided in a wide variety of types, shapes, sizes and performance characteristics. Accordingly, all such modifications are intended to be within the scope of the invention.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

What is claimed is:

1. A personal hydration system for delivering a fluid for consumption by a user, comprising:

an arch-shaped reservoir configured to hold the fluid and having a rigidity for maintaining a substantially constant shape over a range of fluid levels, the reservoir having a first end and a second end, and a top side defining a first curvilinear profile extending between the first end and the second end, and a bottom side defining a second curvilinear profile extending between the first end and the second end, the first and second curvilinear profiles substantially defining the arch-shaped profile of the reservoir;

an angularly extending neck portion integrally formed with the first end of the reservoir;

a fluid delivery port integrally formed with the second end of the reservoir and configured to engage a fluid delivery tube; and a first raised portion and a second raised portion extending from the top side, the first raised portion having a first side and a second side, each side defining a channel configured to at least partially retain the fluid delivery tube.

2. The system of claim 1 wherein the reservoir, the neck portion, the fluid delivery port and the channel are unitarily formed in a blow-molding operation.

3. The system of claim 1 wherein the reservoir is formed with a width-to-depth ratio of approximately 2 to 1.

4. The system of claim 1 wherein the neck portion extends at an angle of approximately 30 degrees.

5. The system of claim 1 further comprising a cap configured to engage the neck portion in a substantially leak-tight manner.

6. The system of claim 5 further comprising a vent valve within the cap configured to minimize formation of a vacuum within the reservoir.

7. The system of claim 1 further comprising a gripping structure integrally formed with the reservoir.

8. The system of claim 1 further comprising a pack configured to receive the reservoir and wherein the reservoir at least partially provides a frame for the pack.

9. The system of claim 1 wherein the second raised portion is disposed proximate the second end of the reservoir and the fluid delivery port extends from the second raised portion toward the first raised portion.

10. The system of claim 9 wherein the first raised portion and the second raised portion each have a top surface extending along a third curvilinear line.

11. The system of claim 1 wherein the neck portion is integrally formed with the first raised portion.

12. A personal hydration system for delivering a fluid for consumption by a user, comprising:

a reservoir having a first end and a second end and configured to hold the fluid and having a rigidity for maintaining a substantially constant shape over a range of fluid levels, the reservoir also including a bottom side defining a first arch that extends at least partially between the first end and the second end, and a top side defining a second arch that extends at least partially between the first end and the second end, the first arch and the second arch defining an arched profile of the reservoir;

an angularly extending neck portion integrally formed with the first end of the reservoir;

a first raised portion projecting from the top side and extending proximate the neck portion toward the second end of the reservoir, the first raised portion having a first side and a second side, at least one of the first side and the second side defining a channel;

a second raised portion extending from the second end of the reservoir toward the first end of the reservoir; and a fluid delivery port extending from the second raised portion toward the first raised portion and configured to engage a fluid delivery tube, the delivery tube configured to be releasably retainable within the channel.

13. The system of claim 12 wherein the first raised portion and the second raised portion each have a top surface extending along a common curvilinear line.

14. The system of claim 12 wherein the fluid delivery port includes a draw tube having an opening disposed within the reservoir proximate the second end.

15. The system of claim 12 wherein the first arch and the second arch are different from one another.

16. The system of claim 12 wherein the first side and the second side of the first raised portion each define a channel configured to at least partially retain the fluid delivery tube.

17. The system of claim 16 further comprising a second raised portion projecting from the top side and extending proximate the second end of the reservoir toward the first end of the reservoir.

18. The system of claim 16 wherein the fluid delivery port extends from the second raised portion toward the first raised portion.

19. The system of claim 12 wherein the top side further defines a third arch extending transverse to the second arch.

* * * * *